US005677030A

United States Patent [19]

Shanok et al.

[11] Patent Number: 5,677,030

[45] Date of Patent: Oct. 14, 1997

[54] SPILLPROOF SHELF ASSEMBLY FOR REFRIGERATORS, FREEZERS AND THE LIKE

[75] Inventors: Daniel Shanok, Warren, N.J.; William Shanok, New York, N.Y.; Joseph Limansky, East Brunswick; Victor Matias, Branchburg, both of N.J.

[73] Assignee: Silvatrim Associates, South Plainfield, N.J.

[21] Appl. No.: 638,473

[22] Filed: Apr. 26, 1996

[51] Int. Cl.[6] ..... E06B 7/16

[52] U.S. Cl. ..... 428/122; 49/501; 108/27; 428/14; 428/45; 428/358

[58] Field of Search ..... 428/14, 45, 122, 428/358; 49/501; 108/27

[56] References Cited

U.S. PATENT DOCUMENTS

| | | | |
|---|---|---|---|
| 2,646,326 | 7/1953 | Stanitz | 108/27 |
| 4,031,665 | 6/1977 | Abramson | 49/501 |
| 4,349,994 | 9/1982 | Maekawa | 428/122 X |
| 5,332,611 | 7/1994 | Shanok et al. | 428/122 |

*Primary Examiner*—Henry F. Epstein
*Attorney, Agent, or Firm*—Goodman & Teitelbaum, Esqs.

[57] ABSTRACT

A shelf assembly for refrigerators, freezers and the like including a glass shelf, an extruded edge trim wrapped around and enclosing the peripheral edges of the shelf, and a shelf supporting unit including a pair of side brackets connected together by spaced apart front and rear bars, the edge trim having a U-shaped construction for receiving the peripheral edges of the shelf therein, so that the edge trim provides a rectangular frame arrangement around the shelf to form a raised dam barrier adjacent the peripheral edges of the shelf to prevent any spilled liquid from running off an upper surface of the shelf, thus making the shelf spillproof. Cut-out securement openings are provided in the shelf edge trim to receive the front and rear bars therein, one of the bars being hooked in one pair of cut-outs, and the other one of the bars being snapped into the other pair of cut-outs. In one modified embodiment, a sealing fin of soft, resilient, flexible and deformable material is provided longitudinally along an upper free end of the U-shaped edge trim to provide a tight seal between the edge trim and the shelf.

20 Claims, 3 Drawing Sheets

SPILLPROOF SHELF ASSEMBLY FOR REFRIGERATORS, FREEZERS AND THE LIKE

BACKGROUND OF THE INVENTION

The invention relates to shelf assemblies for refrigerators, freezers and the like, and more particularly to a spillproof shelf assembly including a shelf edge trim wrapped around a glass shelf, the shelf edge trim having cut-out means therein for securing the shelf edge trim to a pair of side brackets which are usually used for the shelf installation in a refrigerator or freezer.

At present, when a liquid container leaks on a refrigerator shelf, the liquid content easily runs along the shelf and down through the normal openings in the shelf to the lower shelves. For example, U.S. Pat. No. 5,332,611 shows front and rear shelf edge trims, each having a U-shaped body portion for receiving a glass shelf of a refrigerator or freezer therein, and for securing the glass shelf to the front and rear bars of the side brackets. In this case, though the front and rear shelf edge trims provide an excellent locking mechanism to secure the glass shelf to the side brackets, the spilled liquid can easily run down through the space between the glass shelf and the side brackets on opposite sides thereof.

Accordingly, there is presently a need for a shelf edge trim which can be wrapped around the glass shelf, and thus create a dam to prevent liquid from running off the glass shelf to the lower shelves, as well as for supporting the glass shelf on the side brackets, and additionally for providing a locking mechanism to install the glass shelf onto the side brackets, where the shelf edge trim should be inexpensive to manufacture and easily installed at a reasonable price.

SUMMARY OF THE INVENTION

It is accordingly an object of the present invention to provide a shelf assembly for refrigerators, freezers and the like which avoids the problems and disadvantages of the prior art devices.

Another object of the present invention is to provide a shelf assembly for refrigerators, freezers and the like which includes a shelf edge trim for wrapping around and enclosing the peripheral edges of the glass shelf therein.

A further object of the present invention is to provide a shelf edge trim, as described above, which can be formed from an extruded thermoplastic strip.

Still another object of the present invention is to provide a shelf edge trim, as described above, which is provided with locking means for securement thereof on the side brackets of the shelf assembly.

Another object of the present invention is to provide a shelf edge trim, as described above, which forms a rectangular frame arrangement completely around the glass shelf to provide a raised dam barrier to prevent any spilled liquid from running off the upper surface of the glass shelf so that the glass shelf is spillproof.

Yet another object of the present invention is to provide a shelf edge trim, as described above, where the locking means include pairs of cut-outs in the shelf edge trim to receive the front and rear bars of the side brackets to secure the shelf edge trim with the glass shelf to the side brackets.

A further object of the present invention is to provide a shelf edge trim, as described above, which includes a sealing fin of soft, resilient, flexible and deformable material disposed longitudinally along a free edge of the shelf edge trim so that a tight seal is made between the shelf edge trim and the glass shelf.

And still yet another object of the present invention is to provide a shelf edge trim, as described above, which can be easily and inexpensively manufactured, and which permits the shelf edge trim to be easily and quickly installed on the glass shelf.

Briefly, in accordance with the present invention, there is provided a shelf assembly including a glass shelf, an extruded edge trim wrapped around and enclosing the peripheral edges of the glass shelf, and a shelf supporting unit including a pair of side brackets connected together by spaced apart front and rear bars. The edge trim has a U-shaped construction for receiving the peripheral edges of the glass shelf therein, where the edge trim forms a rectangular endless frame arrangement completely around the glass shelf to provide a raised, continuously extending dam barrier adjacent the peripheral edges of the glass shelf to prevent any spilled liquid from running off an upper surface of the glass shelf so that the glass shelf is spillproof. The securement means include pairs of cut-outs in the shelf edge trim to receive the front and rear bars therein where one of the cut-out pairs hooks onto one of the bars, and the other cut-out pair snaps onto the other bar. In one modified embodiment, a sealing fin of soft, resilient, flexible and deformable material is provided longitudinally along an upper free end of the U-shaped shelf edge trim to provide a tight seal between the shelf edge trim and the glass shelf.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

In the various figures of the drawings, like reference characters designate like parts.

DESCRIPTION OF THE PREFERRED EMBODIMENTS

Figure 1:
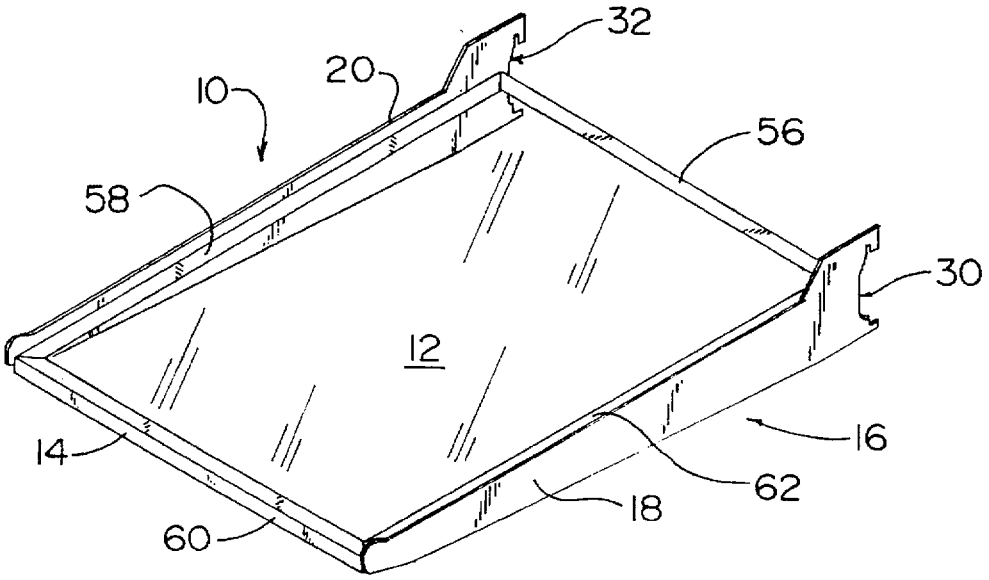
FIG. 1 is a perspective view showing a refrigerator or freezer spillproof shelf assembly provided with a frame-like edge trim for wrapping around and enclosing the peripheral edges of the glass shelf therein in accordance with the present invention.
Figure 2:
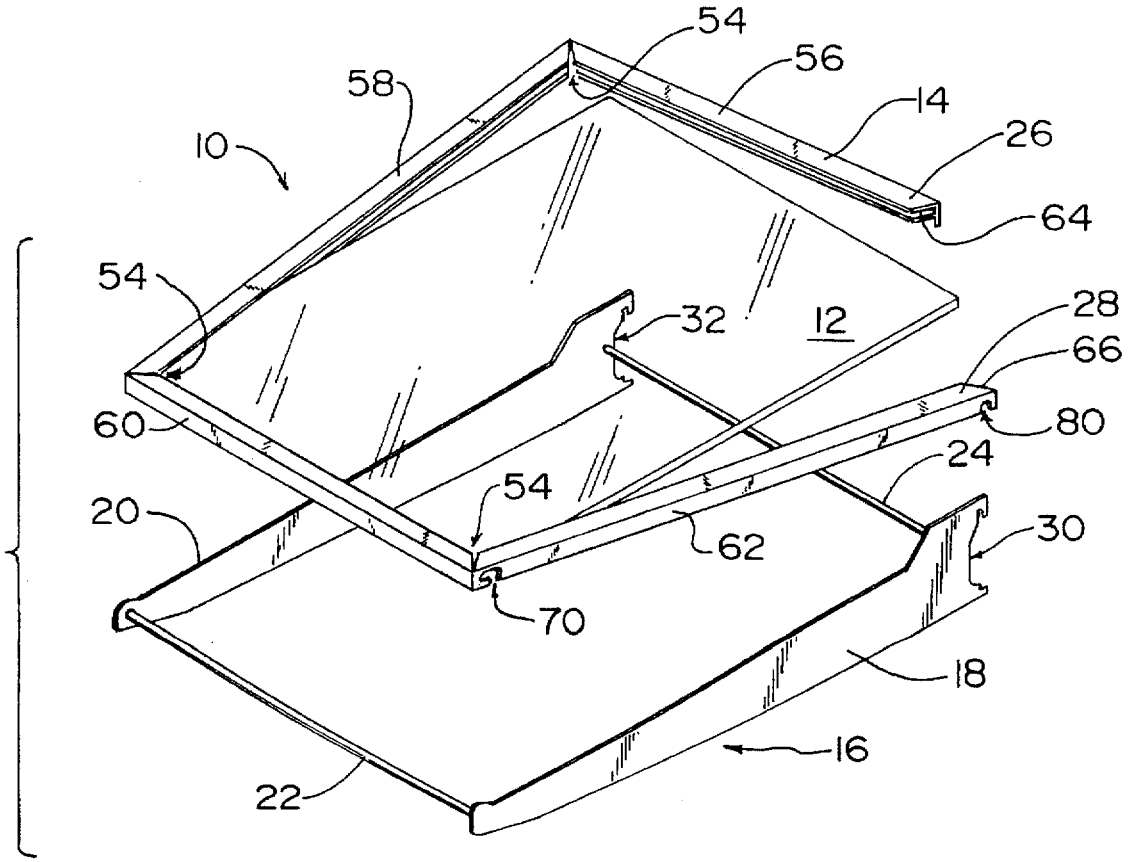
FIG. 2 is an exploded perspective view of the spillproof shelf assembly shown in FIG. 1.

Referring now to the drawings, FIGS. 1 and 2 show a spillproof shelf assembly 10, particularly for refrigerators and freezers, including a glass shelf 12, a frame-like edge trim 14 wrapped around and enclosing the peripheral edges of the glass shelf 12 therein, and a shelf supporting unit 16 including a pair of shelf-support side brackets 18, 20 connected together by a pair of transversely extending front and rear bars or rods 22, 24. The opposite ends 26, 28 of the edge trim 14 can be fitted onto the glass shelf 12 in a tight fit for securement thereto, or well known commercially available sealing means can be used to fixedly secure the ends 26, 28 to the glass shelf 12, such as various adhesives, heat sealers, magnetic resonance sealers or any other common sealing technique well known in the art. Preferably, the ends 26, 28 of the edge trim 14 are secured together at the rear of the glass shelf 12.

Thus, when the edge trim 14 is wrapped around the peripheral edges of the glass shelf 12 in a tight fit, a dam is created by the frame-like edge trim 14 to prevent any liquid from running off the top surface of the glass shelf 12 to any of the lower shelves in the refrigerator or freezer. Accordingly, the frame-like edge trim 14 is raised above the glass shelf 12 and acts as a spillproof mechanism for the glass shelf 12. Preferably, the edge trim 14 has a sealant/mastic material therein to provide a proper seal between the edge trim 14 and the glass shelf 12 so that the edge trim 14 acts as a raised barrier to prevent any liquid from escaping from the top surface of the glass shelf 12. Obviously, the glass shelf 12 can only be considered spillproof when the spilled liquid on the top surface of the glass shelf 12 has a surface level which is approximately equal to or less than the top surface of the edge trim 14, which just about covers most liquid spills.

As best shown in FIG. 2, the front bar 22 is securely fixed between the front end portions of the side brackets 18, 20, and likewise, the rear bar 24 is securely fixed between the rear end portions of the side brackets 18, 20 to secure the side brackets 18, 20 in a predetermined spaced apart arrangement. Each of the side brackets 18, 20 tapers outwardly from the front end portions thereof to the rear end portions thereof to provide enlarged rear end portions thereon. The rear ends of the side brackets 18, 20 are provided with conventional attachment means 30, 32, respectively, which are well known in the art for hooking the shelf assembly 10 onto the rear wall of a refrigerator or freezer, where a further discussion thereof is not thought necessary.

Figure 3:
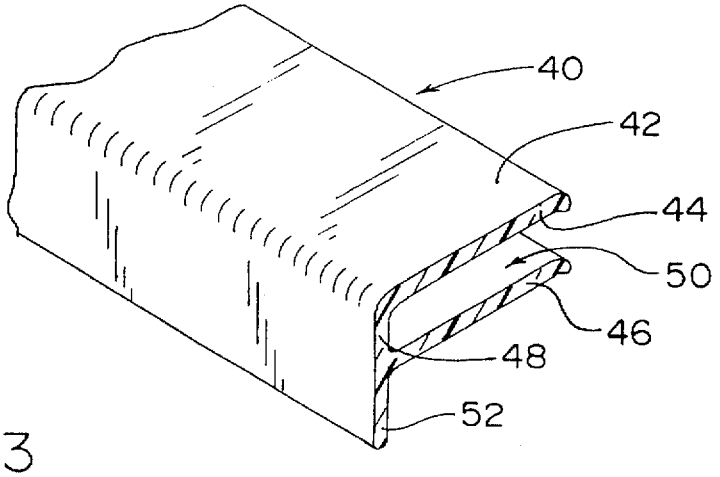
FIG. 3 is a fragmented perspective view showing an extruded edge trim in accordance with the present invention.

The edge trim 14 is constructed from a continuously extruded strip 40 of thermoplastic material, such as acrynitrile butadiene styrene commonly referred to as ABS, as shown in FIG. 3. The strip 40 can be made in any color or texture as desired to provide a particular decorative appearance. Furthermore, the strip 40 can be fabricated from a transparent material to encapsulate a metalic strip or material, such as metalized mylar, a tin foil and the like therein, as disclosed in U.S. Pat. No. 3,730,577, to provide a metalic appearance, such being well known in the art. It is noted, that the metalic strip can be fabricated from a stiff rigid metal material to strengthen the edge trim 14.

The strip 40 preferably has an overallF-shaped cross section to provide a substantially U-shaped portion 42 including an upper arm 44 spaced apart, in a parallel relationship, from a lower arm 46, the arms 44, 46 being connected together by a bight portion 48 to provide an opening 50 therebetween for receiving the glass shelf 12 therein. The bight portion 48 extends downwardly below and perpendicular to the lower arm 46 to provide a skirt or side portion 52.

Figure 4:
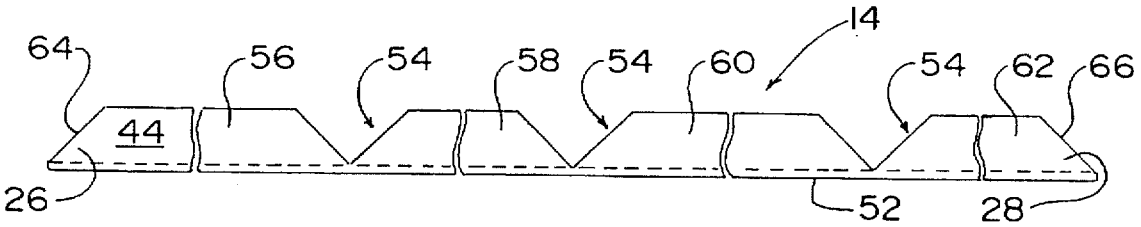
FIG. 4 is a fragmented top plan view showing the edge trim of FIG. 3 cut to a predetermined length and selectively notched.

As indicated in FIG. 4, the strip 40 is cut to a predetermined length to provide the edge trim 14. Using a special commercially available tool (not shown), three notches 54 are formed through the upper and lower legs 44, 46 of the edge trim 14. The notches 54 are spaced apart a predetermined distance or interval to provide sections 56, 58, 60 and 62 of selected lengths. It is noted, that if a square configuration is desired when the strip 40 is bent at the notches 54, then the sections 56, 58, 60 and 62 would all have the same length. Likewise, if a rectangular configuration is desired, the two opposing sections 56 and 60 would have the same first length and the other two opposing sections 58 and 62 would have the same second length, where one of these first and second lengths would be longer than the other to provide the rectangular configuration.

It is noted that during the cutting of the notches 54, the above-mentioned tool simultaneously cuts the trailing edge 64 of end section 56 of one strip while also cutting the leading edge 66 of end section 62 of the succeeding strip, where the skirt portion 52 of each strip 40 can be cut before, during or after the notches 54 are cut in order to separate the edge trims 14 from each other.

Preferably, in order to have the ends 26, 28 of the edge trim 14 secured at the rear of the glass shelf, as mentioned above, end section 56 is designated as the rear section 56, so that section 60 becomes front section 60. Likewise, section 58 and end section 62 are now side sections 58, 62, as best shown in FIG. 2. Therefore, to provide the rectangular configuration, side sections 58, 62 are made longer than the rear and front sections 56, 60.

Figure 5:
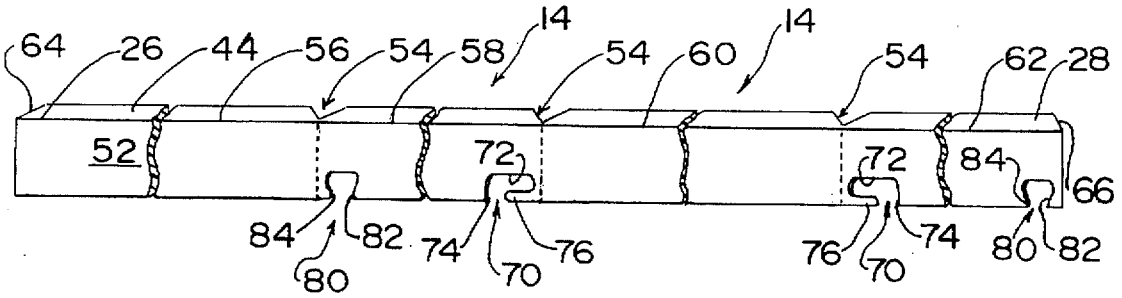
FIG. 5 is a fragmented side perspective view of the edge trim of FIG. 4, showing the side wall thereof being provided with selected cut-outs therein.

In order to mount the edge trim 14 on the shelf supporting unit 16, pairs of cut-outs are provided in the side walls or skirt portions 52 of the edge trim 14, as best shown in FIG. 5. Accordingly, the cut-outs are only provided in the side sections 58, 62, there being front and rear cut-outs in each side section. The first pair of cut-outs are L-shaped front cut-outs 70 having an elongated horizontal opening 72 extending in each case towards the front section 60, and being in communication with the lower transverse opening 74 extending through the bottom edge of each side section 58, 62 to form a hook 76. The other second pair of cut-outs in each case are vertical rear openings 80 extending through the bottom edge of the side sections 58, 62, and being disposed adjacent to the rear section 56 when assembled on the glass shelf 12. The entry walls of the vertical rear openings 80 are tapered to first narrow and then widen each vertical rear opening 80, thus forming converging and diverging tabs 82, 84 at the entrance of each vertical rear opening 80, the function of which will be explained below.

Figure 6:
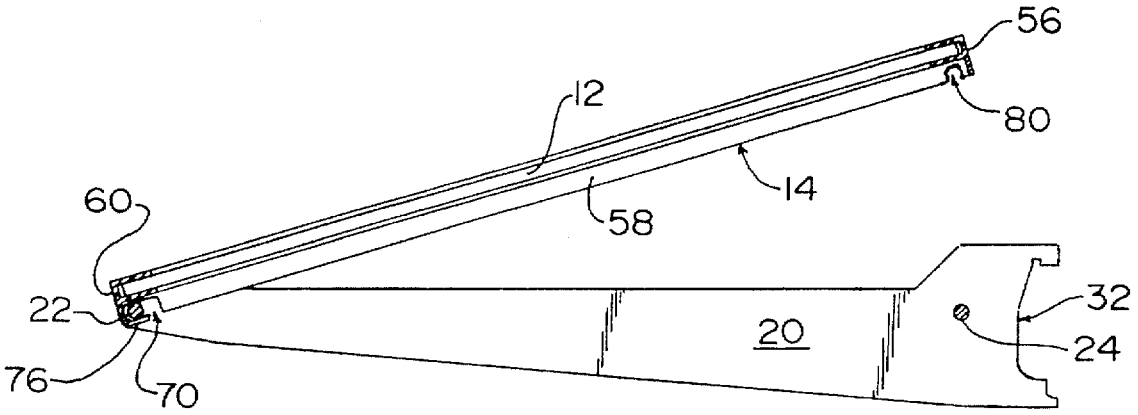
FIG. 6 is a side elevational view, partly in cross section, showing the edge trim wrapped around the glass shelf for pivoting onto the shelf-support side brackets.

In the assembling, of the shelf assembly 10, the edge trim 14 is first wrapped around and secured on the glass shelf 12, as indicated above and shown best in FIG. 2, to form a frame-like dam which acts as a barrier to prevent any liquid from escaping from the top surface of the glass shelf 12. Then the glass shelf 12 with the edge trim 14 secured thereon is positioned so that the front bar 22 passes through the lower transverse opening 74 and is received in the elongated horizontal opening 72 of the L-shaped front cut-out 70 in each of the side sections 58, 62 as shown in FIG. 6. Thus, the edge trim 14 is now hooked onto the front bar 22, where the hook 76 of each front cut-out 70 permits the edge trim 14 with the glass shelf 12 wrapped therein to be pivoted towards the rear bar 24.

Figure 7:
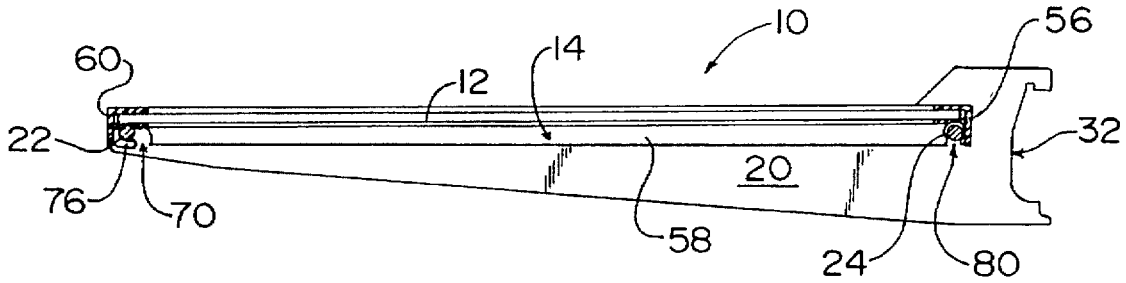
FIG. 7 is a side elevational view, partly in cross section, similar to FIG. 6, showing the edge trim and the glass shelf securely mounted on the shelf-support side brackets.

Once pivoted, each vertical rear opening 80 is brought into alignment with the rear bar 24, where this alignment is permitted by the elongated horizontal opening 72 which allows the edge trim 14 to be adjustably moved transversely relative to the front bar 22. The converging portions of the tabs 82, 84 guide the rear bar 24 into the entrance of the vertical rear openings 80, so that the rear bar 24 can be snapped fully into the vertical rear openings 80. Once the rear bar 24 is completely in the rear openings 80, the diverging portions of the tabs 82, 84 act to block and maintain the rear bar 24 within the rear openings 80. Acccordingly, a certain degree of force would have to be used to lift the edge trim 14 upwardly away from the rear bar 24 in order to disengage the rear bar 24 from the rear openings 80. The shelf assembly 10 is now complete, as shown in FIG. 7, so that the shelf assembly 10 is now ready to be installed within the refrigerator or freezer in a conventional manner well known in the art. As shown above, the shelf assembly 10 can be easily and quickly assembled without the use of any tools.

Figure 8:
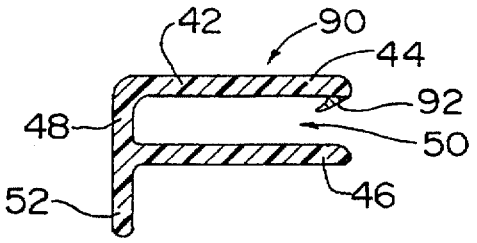
FIG. 8 is a cross-sectional view of a modified extruded edge trim.

FIG. 8 shows a continuously extruded modified strip 90 of thermoplastic material, which is similar to the strip 40 shown in FIG. 3. However, the strip 90 is formed by a twin extrusion, where one material, such as ABS mentioned above, is used to form the structure which is the same as the abovementioned strip 40, such as the F-shaped configuration including the substantially U-shaped portion 42 having the upper and lower arms 44, 46 connected by the bight portion 48 to provide the opening 50 therebetween and the downwardly extending skirt or side portion 52.

Accordingly, a second additional material is used to form the pointed sealing fin 92, such as a soft vinyl material of durometer, such as urethane, longitudinally extending along an undersurface of a free edge of the upper arm 44, so that the pointed sealing fin 92 is directed inwardly towards the bight portion 48. The sealing fin 92 is resilient, flexible and is easily deformed in its function, as mentioned below.

Figure 9:
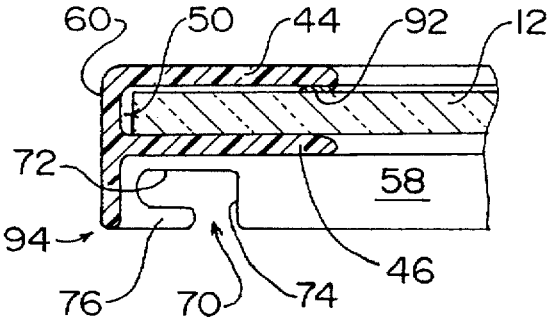
FIG. 9 is a fragmented side elevational view, partly in cross section, showing the edge trim of FIG. 8 disposed on the glass shelf in a spillproof arrangement.

The strip 90 is notched and cut, in the same manner mentioned above, to form an edge trim 94, as shown in FIG. 9, so that the edge trim 94 can be wrapped around the glass shelf 12 and mounted on the front and rear bars 22, 24 of the side brackets 18, 20 in the same manner mentioned above. However, as shown in FIG. 9, when the glass shelf 12 is received in the opening 50 between the upper and lower arms 44, 46, the glass shelf 12 pushes against and flattens out the pointed sealing fin 92 so that a tight seal is provided between the upper arm 44 and the glass shelf 12 to thus prevent any spilled liquid from running off the upper surface of the glass shelf 12.

Numerous alterations of the structures herein discussed will suggest themselves to those skilled in the art. However, it is to be understood that the present disclosure relates to preferred embodiments of the invention which are for purposes of illustration only, and are not to be construed as a limitation of the invention.

What is claimed is:

1. A shelf edge trim for a shelf supported by a pair of side brackets, comprising:

an extruded strip having a U-shaped construction to provide spaced apart parallel upper and lower arms connected together by a bight portion for receiving the shelf therein;

said strip being wrapped around the shelf to provide a rectangular frame arrangement;

said upper arm of said strip being disposed on an upper surface of the shelf when said strip is in said rectangular frame arrangement to provide a raised dam barrier on the shelf to prevent any spilled liquid from running off the upper surface of the shelf so that the shelf is spillproof; and securement means for securing said strip to the side brackets to provide a spillproof shelf assembly.

2. A shelf edge trim according to claim 1, wherein said upper and lower arms are notched at spaced apart intervals to permit said strip to be bent to provide said rectangular frame arrangement.

3. A shelf edge trim according to claim 2, wherein a skirt extends downwardly from said bight portion to provide an F-shaped construction, said securement means including pairs of cut-outs in said skirt.

4. A shelf edge trim according to claim 3, wherein one of said pairs of cut-outs is a pair of L-shaped cut-outs each having an elongated horizontal opening in communication with a lower transverse opening extending through a bottom edge of said skirt.

5. A shelf edge trim according to claim 4, wherein the other one of said pairs of cut-outs is a pair of vertical openings extending through said bottom edge of said skirt with tabs being provided at an entrance to each of said vertical openings.

6. A shelf edge trim according to claim 3, wherein one of said pairs of cut-outs is a pair of vertical openings extending through a bottom edge of said skirt with tabs being provided at an entrance to each of said vertical openings.

7. A shelf edge trim according to claim 1, wherein a sealing fin of soft, resilient, flexible and deformable material is provided longitudinally along a free edge of said upper arm to provide a tight seal between said upper arm and the shelf.

8. A shelf edge time according to claim 1, wherein a skirt extends downwardly from said bight portion to provide an F-shaped construction, said securement means including pairs of cut-outs in said skirt.

9. A shelf edge trim according to claim 8, wherein one of said pairs of cut-outs is a pair of L-shaped cut-outs each having an elongated horizontal opening in communication with a lower transverse opening extending through a bottom edge of said skirt.

10. A shelf edge trim according to claim 8, wherein one of said pairs of cut-outs is a pair of vertical openings extending through a bottom edge of said skirt with tabs being provided at an entrance to each of said vertical openings.

11. A shelf assembly comprising:

a shelf;

an extruded edge trim wrapped around and enclosing peripheral edges of said shelf;

said edge trim having a U-shaped construction to provide spaced apart parallel upper and lower arms connected together by a bight portion for receiving said peripheral edges of said shelf therein;

spillproof means to prevent any spilled liquid from running off an upper surface of said shelf so that said shelf is spillproof, said spillproof means including said upper arm of said edge trim being disposed on said upper surface of said shelf in a rectangular frame arrangement to provide a raised dam barrier around said shelf adjacent said peripheral edges of said shelf;

a shelf supporting unit including a pair of side brackets connected together by spaced apart front and rear bars; and securement means for securing said edge trim to said front and rear bars of said side brackets to provide a spillproof shelf assembly.

12. A shelf assembly according to claim 11, wherein said upper and lower arms are notched at spaced apart intervals to permit said strip to be bent to provide said rectangular frame arrangement.

13. A shelf assembly according to claim 12, wherein a skirt extends downwardly from said bight portion to provide an F-shaped construction, said securement means including pairs of cut-outs in said skirt to receive said front and rear bars.

14. A shelf assembly according to claim 13, wherein one of said pairs of cut-outs is a pair of L-shaped cut-outs each having an elongated horizontal opening in communication with a lower transverse opening extending through a bottom edge of said skirt, one of said front and rear bars being received in each said elongated horizontal opening in a hooked arrangement.

15. A shelf assembly according to claim 14, wherein the other one of said pairs of cut-outs is a pair of vertical openings extending through said bottom edge of said skirt with tab means being provided at an entrance to each of said vertical openings so that the other one of said front and rear bars is snapped into said vertical openings.

16. A shelf assembly according to claim 13, wherein one of said pairs of cut-outs is a pair of vertical openings extending through a bottom edge of said skirt with tab means being provided at an entrance to each of said vertical openings so that one of said front and rear bars is snapped into said vertical openings.

17. A shelf assembly according to claim 11, wherein a sealing fin of soft, resilient, flexible and deformable material is provided longitudinally along a free edge of said upper arm to provide a tight seal between said upper arm and said shelf.

18. A shelf assembly according to claim 11, wherein a skirt extends downwardly from said bight portion to provide an F-shaped construction, said securement means including pairs of cut-outs in said skirt to receive said front and rear bars.

19. A shelf assembly according to claim 18, wherein one of said pairs of cut-outs is a pair of L-shaped cut-outs each having an elongated horizontal opening in communication with a lower transverse opening extending through a bottom edge of said skirt, one of said front and rear bars being received in each said elongated horizontal opening in a hooked arrangement.

20. A shelf assembly according to claim 18, wherein one of said pairs of cut-outs is a pair of vertical openings extending through a bottom edge of said skirt with tab means being provided at an entrance to each of said vertical openings so that one of said front and rear bars is snapped into said vertical openings.

* * * * *